United States Patent [19]

Hirschberg et al.

[11] 4,263,016

[45] Apr. 21, 1981

[54] NON-TOXIC, ACTIVE FILLER FOR GRINDING DISKS, ITS USE AND GRINDING DISK CONTAINING SAME

[75] Inventors: Rudolf Hirschberg; Bernd Schönfeld, both of Bad Nenndorf, Fed. Rep. of Germany

[73] Assignee: Riedel-de Haen Aktiengesellschaft, Seelze, Fed. Rep. of Germany

[21] Appl. No.: 66,235

[22] Filed: Aug. 13, 1979

[30] Foreign Application Priority Data

Aug. 14, 1978 [DE] Fed. Rep. of Germany ..... 2835543

[51] Int. Cl.[3] ..... C09C 1/02

[52] U.S. Cl. ..... 51/309; 51/298; 51/307; 106/304; 423/463

[58] Field of Search ..... 51/307, 309, 298; 260/762; 252/140; 106/304, 290; 423/463

[56] References Cited

U.S. PATENT DOCUMENTS

| | | | |
|---|---|---|---|
| 2,408,319 | 9/1946 | Kistler | 51/307 |
| 2,940,841 | 6/1960 | Gregor et al. | 51/307 |
| 3,111,401 | 11/1963 | Cohen et al. | 51/307 |
| 3,592,618 | 7/1971 | Alden | 51/307 |

*Primary Examiner*—Donald J. Arnold
*Assistant Examiner*—W. Thompson
*Attorney, Agent, or Firm*—Curtis, Morris & Safford

[57] ABSTRACT

In grinding disks, toxic lead chloride and antimony sulfide may be replaced by non-toxic alkali metal chloroferrates (II,III) produced by melting together alkali metal chloride, anhydrous ferric chloride and iron powder.

9 Claims, No Drawings

NON-TOXIC, ACTIVE FILLER FOR GRINDING DISKS, ITS USE AND GRINDING DISK CONTAINING SAME

This invention relates to a non-toxic, active filler for grinding disks, to the use of said filler and to grinding disks containing same.

Grinding disks, for example, for parting by grinding, consist of an abrasive, a binder and active fillers. The mode of action of the fillers has not yet been fully elucidated. The filler may be used to cool the contact zone during grinding and to form a protective and sliding film between the particles of the abrasive and the work piece. In this manner excessive wear of the grinding disk is avoided and good quality of the cutting is obtained. In the absence of active fillers, the cutting surface shows an oxidation color, while with the use of an active filler the said surface has a bright appearance.

A great number of substances have been proposed as active fillers. Suitable fillers are, for example, all anhydrous but water-soluble, non-oxidizing inorganic alkali metal salts and alkaline earth metal salts having melting points in the range of from 700° to 1,200° C. (cf. U.S. Pat. No. 2,216,135).

It is also possible to use oxidizing substances such as potassium permanganate or sodium bichromate, or low melting metals such as zinc, cadmium, tin, lead, antimony and bismuth (cf. U.S. Pat. Nos. 1,984, 423 and 2,258,774). For use in cutting-off wheels mainly lead chloride ($PbCl_2$) and antimony sulfide ($Sb_2S_3$) optionally in admixture with other auxiliaries are employeed in industry.

During grinding these substances evaporate. Since lead and antimony are highly toxic, grinding disks containing these substances present an environment pollution problem. Attempts have been made to overcome this problem by providing the grinding machines with suction equipment. But such equipment is very expensive and complicates grinding. In many cases there is not enough working space for the equipment. Hence, it appears more expedient to work without substances thereby polluting the environment.

It is, therefore, the object of the present invention to replace lead chloride or antimony sulfide as active filler in grinding disks by a substance having a similar effect, and being non-toxic and cheap.

It has now been found that alkali metal chloroferrates (II, III) of the formula I $$A_xFe^{++}{}_yFe_z^{+++}Cl_{x+2y+3z} \quad (I)$$

in which A means an alkali metal ion or an ammonium ion, x is a number from 1 to 10, y is a number from zero to 1, and z is a number from zero to 1 with the proviso that y and z cannot be zero at the same time. Especially suitable as active filler are alkali metal chloroferrates (II) of the formula I in which A means an alkali metal ion, x is a number from 1 to 6, y is 1 and z is zero, and which are used in an amount of from 3 to 15, perferably 4 to 10, % by weight (calculated on the total weight of the grinding disk).

The alkali metal chloroferrates (II, III) to be used according to the invention as active filler for grinding disks are non-toxic and their cutting capacity is similar to that of the toxic substances to be replaced. Moreover, their production is not expensive. They are produced for example by melting together one or several alkali metal chlorides or ammonium chloride, anhydrous ferric chloride and iron powder.

It is especially advantageous to use an alkali metal chloroferrate (II, III) obtained by melting of the aforesaid components in combination with a basic inorganic compound, for example zinc oxide, potassium carbonate or sodium sulfide. The basic compound is preferably used in an amount of from 2 to 5% by weight (calculated on the total weight of all starting components). A combination of this type has a lower acidity than pure alkali metal chloroferrate (II, III). The pH value of a 5% by weight suspension of $K_2FeCl_4$. 2 KCl increases, for example, from 3.8 to 5.2 when additionally 5% of ZnO have been incorporated by melting. With the addition of 3% of $K_2CO_3$ the pH value is raised to 4.8.

Suitable alkali metal ions are, in principle, those of lithium, sodium and potassium. The incorporattion of ammonium ions instead of alkali metal ions or in addition to the latter is also possible. For industrial use the active filler should have as little a hygroscopicity as possible. The hygroscopicity of the filler according to the invention depends on the type and amount of alkali metal contained therein and on the iron (III) content. It diminishes from lithium over sodium to potassium. Too low an alkali metal content and to high an iron (III) content increase the hygroscopicity. Especially good results are obtained with sodium or potassium chloroferrates poor in iron (III), for example those of the composition $A_xFeCl_{x+2}$ (x=1 to 6), i.e. the known compounds $KFeCl_3$, $K_2FeCl_4$, $Na_2FeCl_4$, $NaK_3FeCl_6$ or mixtures of the said compounds with one another or with potassium chloride or sodium chloride.

To make grinding disks the fillers according to the invention can be used either alone or in admixture with other fillers.

It has surprisingly been found that when using the fillers according to the invention for grinding disks, considerably smaller amounts thereof are sufficient than with the use of lead chloride and antimony sulfide without the quality of the cutting being affected. Thus, it is sufficient to add 10% of alkali metal chloroferrate (II) instead of 20% of lead chloride. An advantage of this phenomenon is the fact that the breaking speed, that is to say the circumferential speed at which the grinding disk breaks or bursts, can be increased by about 10% over that of a disk produced with lead chloride when a filler according to the invention is used.

The following examples illustrate the invention.

EXAMPLES

Grinding wheels for parting having a diameter of approximately 600 mm and a thickness of about 8 mm were produced for test purpose from phenol resin, aluminous abrasive and active filler. On a grinding machine the wheels were rotated at increasing circumferential speed until they were destroyed. The values obtained are indicated in the following Table under "bursting speed".

The wheels were used for parting by grinding rod shaped work pieces having a cross sectional area of 100×100 mm and made from a standardized, commercial steel alloy "CK 45 normalized". With each cutting-off wheel a plurality of cuts were made vertically to the longitudinal axis and the loss in diameter of the cutting wheel was determined for each cut. Moreover, the specific cutting efficiency was determined by the diminution of the work piece in the time in $cm^2$ per second and the power factor was calculated, which is the quotient from the diminution of the work piece and the reduction of the cross section of the cutting wheel, each in $cm^2$. In addition, the power consumption of the machine during grinding was recorded and the profile of the cutting wheel as well as the appearance of the cut surface of the work piece after grinding were evaluated. The values obtained are summarized in the Table.

Examples V 1 and V 2 in the table are comparative examples without use of an active filler and with lead chloride, respectively, as filler according to the state of the art.

TABLE

| (a) Example no. | V 1 | V 2 | 1 | 2 | 3 | 4 |
|---|---|---|---|---|---|---|
| (b) filler | — | $PbCl_2$ | $K_2FeCl_4$ | $Na_2FeCl_4$ | $K_2FeCl_4$ . K $FeCl_3$ | $K_2FeCL_4$ 2KCl |
| (c) % by weight of filler | — | 21 | 10.4 | 10.7 | 10.0 | 8.6 |
| (d) wheel diameter (mm) | 605 | 600 | 603 | 600 | 605 | 602 |
| (e) wheel thickness (mm) | 7.9 | 7.6 | 7.9 | 8.2 | 7.9 | 8.0 |
| (f) weight of wheel (kg) | 5.1 | 5.8 | 5.3 | 5.3 | 5.3 | 5.3 |
| (g) bursting speed (m/s) | 160 | 144 | 156 | 155 | 155 | 155 |
| (h) number of cuts | 2 × 5 | 2 × 5 | 3 × 5 | 4 × 5 | 4 × 5 | 4 × 5 |
| (i) circumferential speed (m/s) | 100 | 100 | 100 | 100 | 100 | 100 |
| (k) power consumption (A) | 120 | 120 | 125 | 120 | 130 | 130 |
| (l) loss in diameter per cut (mm) | 43–45 | 14–15 | 24–26 | 23–26 | 23–25 | 17–19 |
| (m) specific cutting efficiency ($cm^2/s$) | 6.9–7.0 | 7.3–7.4 | 6.6–6.8 | 6.6–6.8 | 6.6–6.8 | 6.6–6.8 |
| (n) power factor | 1.2–1.3 | 3.6–3.8 | 2.1–2.3 | 2.1–2.3 | 2.1–2.3 | 2.8–3.1 |
| (o) wheel profile | round | cornered | cornered | cornered | cornered | cornered |
| (p) quality of cut | blue | bright | bright | bright | bright | bright |

What is claimed is:

1. Non-toxic, active filler for grinding disks consisting essentially of an alkali metal chloroferrate (II, III) of the formula I $$A_xFe_y^{++}Fe_z^{+++}Cl_{x+2y+z} \quad (I)$$

in which A means an alkali metal ion or an ammonium ion, x is a number from 1 to 10, y is a number from zero to 1, z is a number from zero to 1, with proviso that y and z cannot be zero at the same time.

2. The filler of claim 1 wherein the alkali metal chloroferrate (II) is a compound as defined by formula I in which A means an alkali metal ion, x is a number from 1 to 6, y is 1 and z is zero.

3. The filler of claim 1 wherein the alkali metal chloroferrate (II, III) is in admixture with a basic inorganic compound.

4. Grinding disk containing as non-toxic, active filler an alkali metal chloroferrate (II, III) as defined in claim 1.

5. The filler of claim 2 wherein the filler is utilized in an amount of 3 to 15% by weight based on the weight of the grinding disk.

6. The filler of claim 3, wherein the basic inorganic compound is zinc oxide, potassium carbonate or sodium sulfide.

7. The filler of claim 1, wherein the grinding disk is a phenolic resin bonded grinding disk.

8. The filler of claim 1, wherein the alkali metal ion is lithium, sodium or potassium.

9. The filler of claim 1, wherein the alkali metal chloroferrate is a compound of the formula $KFeCl_3$, $K_2FeCl_4$, $Na_2FeCl_4$ or $NaK_3FeCl_6$.

* * * * *